US007726695B2

(12) United States Patent
Howes

(10) Patent No.: US 7,726,695 B2
(45) Date of Patent: Jun. 1, 2010

(54) WIRE CONCEALING COVER FOR WIREBOUND BOOKS

(75) Inventor: Abby J. Howes, Sidney Center, NY (US)

(73) Assignee: MeadWestvaco Corporation, Richmond, VA (US)

( * ) Notice: Subject to any disclaimer, the term of this patent is extended or adjusted under 35 U.S.C. 154(b) by 505 days.

(21) Appl. No.: 10/974,590

(22) Filed: Oct. 26, 2004

(65) Prior Publication Data

US 2006/0087111 A1 Apr. 27, 2006

(51) Int. Cl.
*B42D 1/06* (2006.01)
*B42D 3/18* (2006.01)
*B42D 3/12* (2006.01)

(52) U.S. Cl. ..... 281/29; 281/27.1; 281/27.2; 281/31

(58) Field of Classification Search ..... 402/60, 402/70, 79, 57, 73; 24/67 R; 281/15.1, 21, 281/29, 31, 37, 27.1, 27.2; 283/2
See application file for complete search history.

(56) References Cited

U.S. PATENT DOCUMENTS

| | | | | |
|---|---|---|---|---|
| 906,596 | A | 12/1908 | Morden | |
| 1,121,197 | A * | 12/1914 | McMillan | 402/31 |
| 2,082,423 | A | 6/1937 | Schade | |
| 2,142,816 | A * | 1/1939 | Grumbacher | 281/29 |
| 2,354,598 | A * | 7/1944 | Janz | 439/687 |
| 2,516,809 | A * | 7/1950 | Soderberg | 281/33 |
| 4,711,469 | A | 12/1987 | Bogar | |
| 4,811,973 | A | 3/1989 | Kumar-Misir | |
| 4,907,905 | A | 3/1990 | Fournier | |
| 4,947,564 | A * | 8/1990 | Reece et al. | 40/110 |
| 5,351,992 | A * | 10/1994 | Chilson et al. | 281/31 |
| 5,407,230 | A * | 4/1995 | Brink et al. | 281/15.1 |
| 5,417,510 | A | 5/1995 | Stout | |
| 5,445,467 | A * | 8/1995 | Peleman | 402/57 |
| 5,697,646 | A | 12/1997 | Venegas | |
| 5,713,604 | A * | 2/1998 | Ward, Jr. | 281/21.1 |
| 6,010,157 | A | 1/2000 | Pierson et al. | |
| 6,386,784 | B1 * | 5/2002 | Ruble | 402/60 |
| 6,412,891 | B1 | 7/2002 | Liang et al. | |
| D463,487 | S * | 9/2002 | Savoy | D19/27 |
| 6,682,248 | B2 * | 1/2004 | Lockhart | 402/73 |
| 6,702,330 | B2 | 3/2004 | Roca | |

(Continued)

FOREIGN PATENT DOCUMENTS

DE 910287 * 1/1955

(Continued)

*Primary Examiner*—Dana Ross
*Assistant Examiner*—Pradeep C Battula
(74) *Attorney, Agent, or Firm*—Alison R. Scheidler; Donald G. Bauer

(57) ABSTRACT

The present invention provides a cover for a book having a wire concealment feature incorporated therein. The cover of the present invention generally comprises a front panel, a rear panel attached to and extending from the front panel, and a middle panel that extends from the opposite side of the rear panel. The inwardly facing surface of the front panel includes an elongated tab attached to or integral with its inner edge, with the tab including a longitudinally extending series of holes formed therethrough. A coiled wire passes through the holes formed through the tab, and a book is also attached to the coiled wire thereby interconnecting the book to the cover.

16 Claims, 2 Drawing Sheets

U.S. PATENT DOCUMENTS

| | | | | |
|---|---|---|---|---|
| 6,773,195 | B2 * | 8/2004 | Tims | 402/73 |
| 6,923,590 | B2 * | 8/2005 | Ward et al. | 402/70 |
| 7,025,381 | B2 * | 4/2006 | Lockhart | 281/29 |
| 2003/0210949 | A1 * | 11/2003 | Tims | 402/73 |
| 2004/0170468 | A1 * | 9/2004 | Chizmar | 402/42 |
| 2005/0254885 | A1 * | 11/2005 | Laufer | 402/73 |

FOREIGN PATENT DOCUMENTS

| | | |
|---|---|---|
| DE | 925772 | * 3/1955 |
| FR | 834090 | * 11/1938 |
| FR | 834827 | * 12/1938 |

* cited by examiner

WIRE CONCEALING COVER FOR WIREBOUND BOOKS

BACKGROUND OF THE INVENTION

The present invention relates generally to wirebound books, such as planners, diaries, calendars, and the like, and more particularly to covers for such books that conceal the wire binding the book.

Wirebound books, such as notebooks, diaries, planners, calendars, and the like include, as the term "wirebound" suggests, a coiled wire binding the pages and front and rear covers of the book together. The books typically include front and rear covers composed of a material more durable than the paper pages they protect, such as vinyl, paperboard, or plastic. Exposure of the wire often results in it being caught or snagged on exterior objects, causing at least a partial deformation of the wire. This deformation causes the pages of the book to become more difficult to turn, or worse, causes the pages to partially tear from the wire binding.

There has been at least one solution to the problem caused by exposed wire bindings. Referring to FIG. 1 of the drawings, a prior art wire concealment device is illustrated. The device includes a pocket of material 2 stitched along its opposing longitudinal ends to the outwardly facing surfaces of the front and rear covers 4, 6, respectively. The wire binding 8 is enveloped within pocket 2 and concealed from the exterior of the cover.

While the pocket effectively conceals the wire from becoming caught or snagged by an object, it is only useful with books having separate front and rear covers. In addition, it is possible for the pocket to become caught or snagged on an object, thus partially defeating the purpose for which it was created in the first place.

It is a principal object and advantage of the present invention to provide an improved wire concealment cover for a book.

It is a further object and advantage of the present invention to provide a wire concealment device for a book cover that is maintained in the interior of the book.

It is an additional object and advantage of the present invention to provide a wire concealment device that may be easily manufactured.

Other objects and advantages of the present invention will in part be obvious, and in part appear hereinafter.

SUMMARY OF THE INVENTION

In accordance with the foregoing objects and advantages, the present invention provides a cover for a book having a wire concealment feature incorporated therein. For purposes of this disclosure, the term "book" refers to a plurality of pages bound together, and more specifically, bound together with a coiled wire. Examples of "books" meeting this definition include notebooks (spiral bound), diaries, planners, calendars, appointment books, address/phone books, and the like such as are sold by MeadWestvaco Corporation and are well understood in the art.

The cover of the present invention generally comprises a front panel, a rear panel attached to and extending from the front panel, and a middle panel that extends from the opposite side of the rear panel. The inwardly facing surface of the front panel includes an elongated tab attached to or integral with its inner edge, with the tab including a longitudinally extending series of holes formed therethrough. A coiled wire passes through the holes formed through the tab, and a book is also attached to the coiled wire thereby interconnecting the book to the cover. In addition, by having the tab attached to the inwardly facing surface of the front panel, the coiled wire is concealed from the exterior of the cover.

The front panel is movable about a longitudinal axis relative to the rear panel, and the middle panel is movable about a longitudinal axis relative to the rear panel and is adapted to be folded such that it is positioned between the front and rear panels when the cover is in its closed position.

The rear panel may also include a tab attached to or integral with its inwardly facing surface's longitudinal edge that is adjacent the front panel. This tab is essentially identical to the tab attached to the front panel. A coiled wire may be connected to this tab by passing through a series of longitudinally extending holes that are formed therethrough, and a book may also be attached to the coiled wire.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1A:
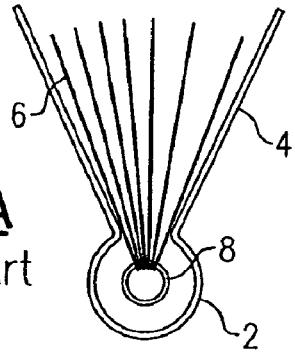
FIG.1A Prior Art
FIGS. 1A and 1B are top plan and rear elevation views, respectively, of a prior art wire concealment book cover.
Figure 1B:
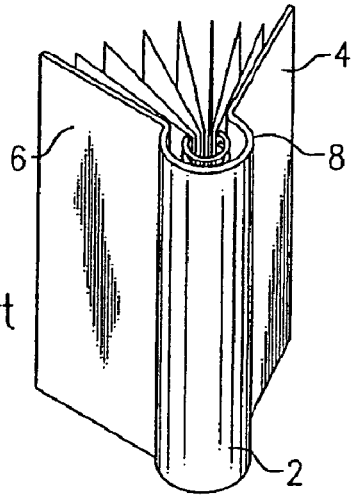
FIG.1B Prior Art
Figure 2:
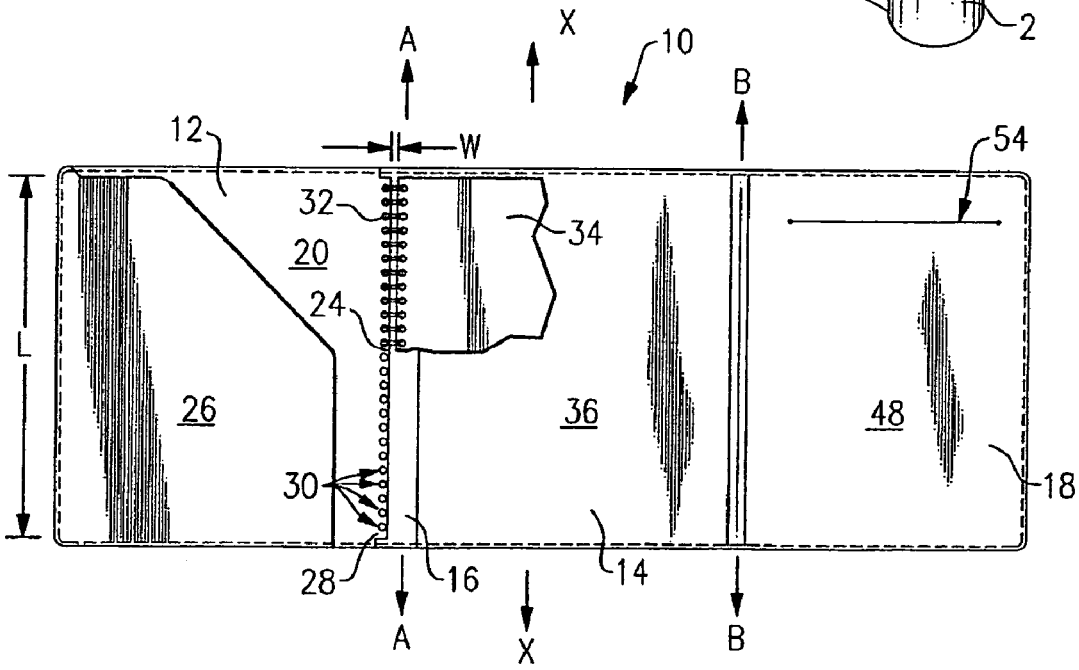
FIG. 2 is a front elevation view of the wire concealment book cover of the present invention, shown in its open position.

Referring now to the drawings, in which like reference numerals refer to like parts throughout, there is seen in FIG. 2 a book cover, designated generally by reference numeral 10, comprising a front panel 12 and a rear panel 14 extending from and movable about a longitudinal axis A-A relative to front panel 12. The cover may comprise a binding 16 of predetermined width interconnecting front panel 12 to rear panel 14, each of said front and rear panels being pivotally movable relative to binding 16 about a second axis that is essentially parallel to the longitudinal axis A-A. A middle panel 18 extending from the edge of rear panel 14 opposite front panel 12 is also provided, and is movable relative to rear panel 14 about a longitudinal axis B-B that is essentially parallel to axis A-A. Middle panel 18 is adapted to be folded over between a book 34 fastened to front panel 12 and a book 40 (see FIG. 4) fastened to rear panel 14. Book cover 10 may be made from conventional materials well known in the art, preferably flexible in nature, such as vinyl, paper board or simulated leather, for example.

Figure 6:
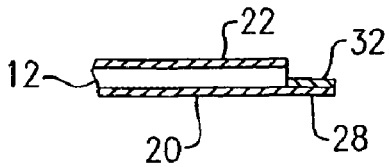
FIG. 6 is a cross-sectional view taken along section line 6-6 of FIG. 5.

Front panel 12 includes inwardly and outwardly planar surfaces 20, 22, respectively, and a distinct inner edge 24 formed on inwardly facing surface 20 and extending essentially parallel to longitudinal axis A-A. A pocket 26 may be formed on inwardly facing surface 20 to retain a loose-leaf sheet of paper in front panel 12. As illustrated in FIG. 6, front panel 12 (as well as rear panel 14 and middle panel 18) may be of two ply construction.

A tab 28 extends longitudinally from inner edge 24. Tab 28 is of a predetermined width W and length L and can be either integrally formed relative to inwardly facing surface 20 or attached thereto via stitching, gluing, or other conventional fastening process. A series of holes 30 are formed longitudinally through tab 28 and receive a conventional coiled wire 32 therethrough, thereby attaching coiled wire 32 to tab 28. A book 34 comprising a plurality of sheets of paper that include a series of longitudinally extending holes formed therethrough adjacent one edge thereof is also attached to coiled wire 32. Thus, book 34 is attached to tab 28, and hence book cover 10, via coiled wire 32, and coiled wire 32 is concealed from the exterior of cover 10 due to the positioning of tab 28 on inwardly facing surface 20.

Figure 3:
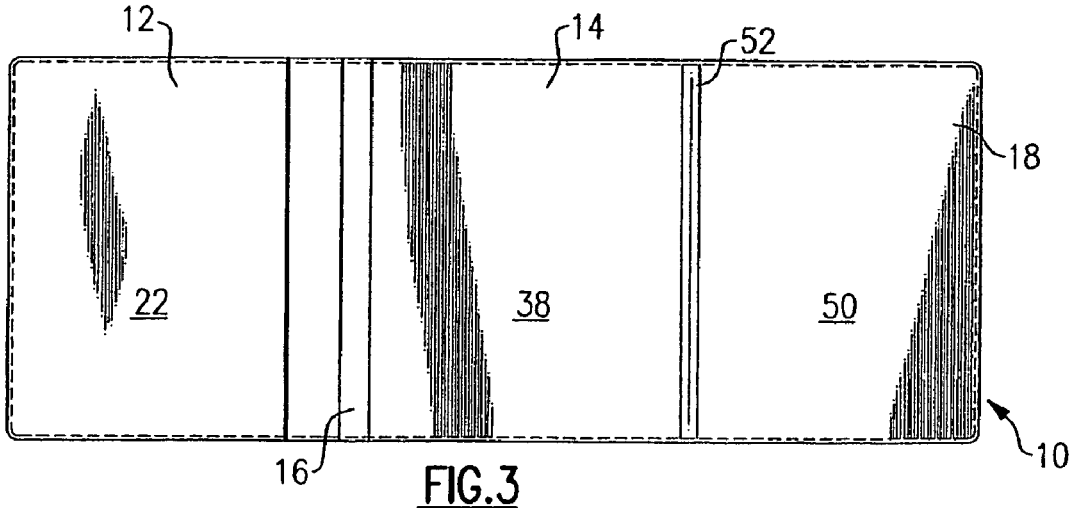
FIG. 3 is a rear elevation view of the wire concealment book cover of the present invention, shown in its open position.
Figure 5:
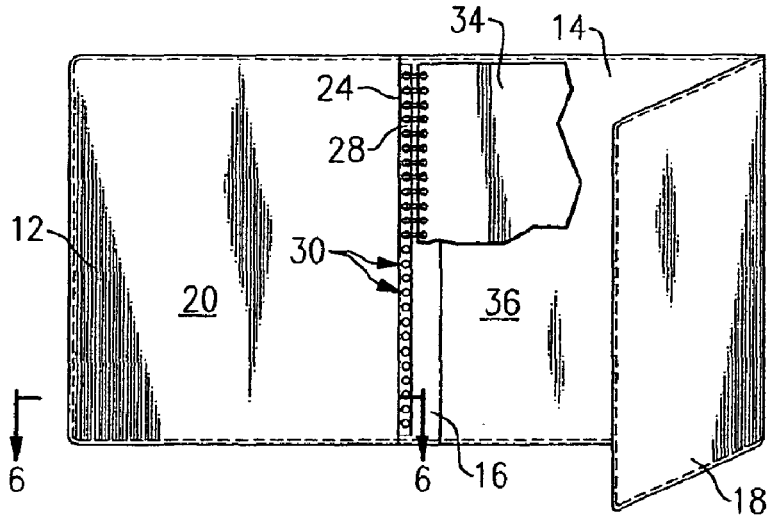
FIG. 5 is a front elevation view of the present invention shown with the middle panel in a partially folded position.

In the embodiment of FIGS. 2, 3 and 5, rear panel 14 includes inwardly and outwardly facing surfaces 36, 38, respectively. In its construction, rear panel 14 is two ply and is stitched about its periphery except for its longitudinal edge that is adjacent front panel 12 which remains open and defines a pocket between the two plies. A second book 40 may have its rear panel inserted into the pocket defined between inwardly and outwardly facing surfaces 36 and 38.

Figure 4:
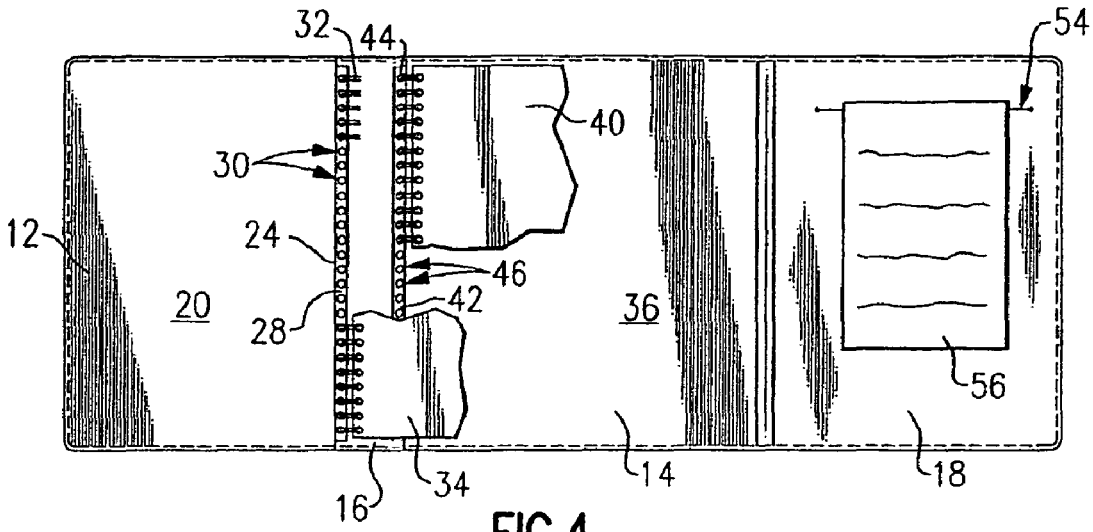
FIG. 4 is a front elevation view of an alternate embodiment of the book cover, shown in its open position.

In the embodiment of FIG. 4, rear panel 14 includes a tab 42 extending from the longitudinal edge of inwardly facing surface 36 adjacent front panel 12. Tab 42 is virtually identical to tab 28 and includes a coiled wire 44 that passes through the holes 46 that are formed through the tab in a longitudinal series. Book 40 is also attached to coiled wire 44.

Middle panel 18 includes inwardly and outwardly facing surfaces 48, 50, respectively, and is actually positioned to the side opposite front panel 12 relative to rear panel 14, thus making it appear as if rear panel 14 is actually the "middle" panel when cover 10 is placed in its fully open position. However, middle panel 18 is movable about the longitudinal axis B-B that extends through the binding 52 and joins middle panel 18 to rear panel 14, and is intended to be folded between front panel 12 and rear panel 14 when cover 10 is being carried or is otherwise not in use and it is useful to provide protection to books 34 and 40.

As a further accessory of cover 10, middle panel 18 is provided with a slit 54 that extends transverse to axes A-A and B-B, and that provides access to a pocket 16 that exists between the two plies that comprise middle panel 18. A pad of paper 56 or similar accessory can be securely stored in middle panel 18 by inserting its rear cover through slit 54.

Panels 12, 14, and 18 may be at least a partial unitary construction, i.e., a single sheet of material forming the outwardly facing surfaces 22, 38, and 50, respectively, or may be composed of several sheets of material stitched together. It should also be understood that the term "book" as used herein may refer to a planner, appointment book, notebook, calendar, diary, journal, address/telephone book, and the like that are well understood in the art. The description of the invention contained herein is of the best mode known to the inventor for practicing the invention, but it should be understood that the scope and spirit of the invention should not be limited to the specific embodiments described but rather extend to the full extent defined by the appended claims.

What is claimed is:

1. A cover for at least one wirebound book having a plurality of pages and a longitudinal axis, said cover comprising:

a. a front panel having planar inwardly and outwardly facing surfaces, said inwardly facing surface having an interior edge extending essentially parallel to the longitudinal axis of the book;

b. a first tab associated with and extending from said interior edge;

c. a first wire interconnected to said first tab and adapted for binding the pages of a first book, said first wire being a coiled wire;

d. a rear panel interconnected to said front panel, said rear panel including inwardly and outwardly facing surfaces, wherein a pocket is defined between said inwardly and outwardly facing surfaces of said rear panel, said pocket being open along the longitudinal edge thereof that is adjacent the front panel and closed along the other edges of said pocket, wherein said pocket receives a cover of a second book having a binding other than the first wire and not binding the first book; and e. a middle panel interconnected to said rear panel, wherein said middle panel is folded between said front and rear panels when said cover is closed.

2. The cover according to claim 1, further comprising a binding of predetermined width interconnecting said front panel to said rear panel, each of said front and rear panels being pivotally movable relative to said binding about a second axis that is essentially parallel to the longitudinal axis.

3. The cover according to claim 1, wherein said inwardly facing surface of said rear panel includes a second tab associated therewith and extending therefrom, and a second wire interconnected to said second tab and adapted for binding the pages of a book.

4. The cover according to claim 3, wherein said second tab is integral with said inwardly facing surface.

5. The cover according to claim 3, wherein said second tab is affixed to said inwardly facing surface.

6. The cover according to claim 3, wherein said first tab is integral with said inwardly facing surface.

7. The cover according to claim 3, wherein said first tab is affixed to said inwardly facing surface.

8. A cover for at least one wirebound book having a plurality of pages and a longitudinal axis, said cover comprising:

a. a front panel having planar inwardly and outwardly facing surfaces, said inwardly facing surface having an interior edge extending essentially parallel to the longitudinal axis of the book;

b. a first tab associated with and extending from said interior edge;

c. a first wire interconnected to said first tab and adapted for binding the pages of the book, said first wire being a coiled wire;

d. a rear panel interconnected to said front panel through a binding other than the first wire and not binding the first book, said rear panel including inwardly and outwardly facing surfaces; and e. a middle panel interconnected to said rear panel, wherein said middle panel is folded between said front and rear panels when said cover is closed.

9. The cover according to claim 8, wherein said middle panel and rear panel are pivotally moveable relative to one another about a third axis that extends essentially parallel to the longitudinal axis.

10. The cover according to claim 8, wherein said middle panel includes a pocket formed therein with an opening for said pocket formed along a fourth axis that is transverse to said longitudinal axis.

11. A cover for at least one wirebound book having a plurality of pages and a longitudinal axis, said cover comprising:

a. a front panel comprising at least first and second plies of material, said first ply defining a planar inwardly facing surface and said second ply defining an outwardly facing surface, said inwardly facing surface having an interior edge extending essentially parallel to the longitudinal axis of the book;

b. a first wire interconnected to said inwardly facing surface and separated from said outwardly facing surface, said first wire adapted for binding the pages of a first book, said first wire being a coiled wire;

c. a rear panel interconnected to said front panel, said rear panel including inwardly and outwardly facing surfaces, wherein a pocket is defined between said inwardly and outwardly facing surfaces of said rear panel, said pocket being open along the longitudinal edge thereof that is adjacent the front panel and closed along the other edges of said pocket, wherein said pocket receives a cover of a second book having a binding other than the first wire and not binding the first book, and d. a middle panel interconnected to said rear panel, wherein said middle panel is folded between said front and rear panels when said cover is closed.

12. The cover according to claim 11, further comprising a binding of predetermined width interconnecting said front panel to said rear panel, each of said front and rear panels being pivotally movable relative to said binding about a second axis that is essentially parallel to the longitudinal axis.

13. The cover according to claim 11, wherein said middle panel and rear panel are pivotally moveable relative to one another about a third axis that extends essentially parallel to the longitudinal axis.

14. The cover according to claim 11, wherein said middle panel includes a pocket formed therein with an opening for said pocket formed along a fourth axis that is transverse to said longitudinal axis.

15. A cover for at least one wirebound book having a plurality of pages and a longitudinal axis, said cover comprising:

a. a front panel comprising at least first and second plies of material, said first ply defining a planar inwardly facing surface and said second ply defining an outwardly facing surface, said inwardly facing surface having an interior edge extending essentially parallel to the longitudinal axis of the book;

b. a first wire interconnected to said inwardly facing surface and separated from said outwardly facing surface, said first wire adapted for binding the pages of the book, said first wire being a coiled wire;

c. a rear panel interconnected to said front panel, said rear panel including inwardly and outwardly facing surfaces, wherein said inwardly facing surface of said rear panel includes a second wire interconnected thereto that is adapted for binding the pages of a second book and not binding the first book, and d. a middle panel interconnected to said rear panel, wherein said middle panel is folded between said front and rear panels when said cover is closed.

16. The cover according to claim 15, wherein said second wire is a coiled wire.

* * * * *